US009921550B2

(12) United States Patent
Holden

(10) Patent No.: US 9,921,550 B2
(45) Date of Patent: Mar. 20, 2018

(54) COLLAPSIBLE CHESS CLOCK

(71) Applicant: William Holden, Durango, CO (US)

(72) Inventor: William Holden, Durango, CO (US)

( * ) Notice: Subject to any disclaimer, the term of this patent is extended or adjusted under 35 U.S.C. 154(b) by 0 days.

(21) Appl. No.: 15/376,409

(22) Filed: Dec. 12, 2016

(65) Prior Publication Data

US 2017/0168459 A1 Jun. 15, 2017

Related U.S. Application Data

(60) Provisional application No. 62/266,658, filed on Dec. 13, 2015.

(51) Int. Cl.

| | |
|---|---|
| ***G04C 3/00*** | (2006.01) |
| ***A63F 3/00*** | (2006.01) |
| ***A63F 3/02*** | (2006.01) |
| ***G07C 1/28*** | (2006.01) |

(52) U.S. Cl.

CPC ..... *G04C 3/001* (2013.01); *A63F 3/00895* (2013.01); *A63F 3/02* (2013.01); *G07C 1/28* (2013.01); *A63F 2250/1084* (2013.01); *A63F 2250/18* (2013.01)

(58) Field of Classification Search

CPC ... G04C 3/001; G04C 3/00; A63F 3/02; A63F 2250/1084; G04B 37/00; G04B 37/04; G07C 1/28

USPC ..... 368/96

See application file for complete search history.

(56) References Cited

U.S. PATENT DOCUMENTS

| | | | | |
|---|---|---|---|---|
| 2,125,294 | A * | 8/1938 | Lathrop | 206/37 |
| 4,362,393 | A | 12/1982 | Tissot | |
| 4,681,463 | A | 7/1987 | Bendit | |
| 4,884,255 | A | 11/1989 | Fischer | |
| 5,898,600 | A * | 4/1999 | Isashi | G06F 1/1618 345/169 |
| D420,704 | S * | 2/2000 | Coe | D10/2 |
| D511,692 | S * | 11/2005 | Chan | D10/15 |
| 7,029,170 | B2 * | 4/2006 | Bailey | A63B 69/12 340/323 R |
| 8,087,672 | B2 | 1/2012 | Malobabic | |
| D674,293 | S * | 1/2013 | Lee | D10/15 |
| 2005/0239553 | A1 | 10/2005 | Wilson et al. | |
| 2011/0110198 | A1 * | 5/2011 | Bulsink | A63F 11/00 368/96 |

* cited by examiner

*Primary Examiner* — Sean Kayes

(74) *Attorney, Agent, or Firm* — Bradford E. Kile; Scott Houtteman; Kile Park Reed & Houtteman PLLC

(57) ABSTRACT

A collapsible chess clock including four interconnected generally planar panels that are operable to be erected into opposing player, digital time information centers wherein two of the panels reflect a player time decrement pause capacity upon completion of a player move and an on the clock position of an opposing player and two the panels reflect each player's time remaining to forfeiture of the game.

10 Claims, 2 Drawing Sheets

COLLAPSIBLE CHESS CLOCK

CROSS-REFERENCE TO RELATED APPLICATION

This application claims the priority of applicant's U.S. Provisional Application Ser. No. 62/266,658 filed on Dec. 13, 2015. The content of applicant's Provisional Application is hereby incorporated by reference as thought set forth at length.

BACKGROUND OF THE INVENTION

This invention relates to a compact, collapsible chess clock that is operable to be stored in a compact space for transport and storage while concomitantly being operable to be facilely setup into a functional chess clock for accurate timing of game movement activity and a definitive signal of a time dependent chess match winner.

Chess is a popular game played around the world between two players. Victory is usually determined when a player "checkmates" an opponent's king.

With the number of permutations of permissible moves and combinations or sequences of moves competitive chess from a neophyte to master level can be wonderfully complex. Moreover, beginning in 1883, in London, time was added as an element to the game in tournament play to add a further level of skill challenge and player differentiation. Generally speaking, if a checkmate hasn't decided the game, the player who runs out of time first forfeits a match.

Chess clocks keep track of each player's time by decrementing down during a player's turn. The more time a player takes to make an individual move, the more cumulative time elapses for the player. In tournament play an initial period of two hours is usually allocated to each player to complete forty moves. If one player does not successfully execute forty moves within the precise period of two hours or less the player forfeits automatically. After the primary two hour period a secondary period of an additional hour to execute an additional number of moves can be assigned. Time not used in a player's primary period can be added to the player's secondary period. A player utilizes no time consumption at all while an opponent is "on the clock."

A game played with the addition of time constraints and forfeiture for failing to meet a time limitation needs an accurate and objective definition of exceeding any set time period in order of both players to radially accept forfeiture from exceeding a time limitation during play.

Chess clocks have gained in popularity for casual play. A clock not only helps players develop quick cognitive skills, but maintaining a strict time limit for games keeps the length of games to a mutually agreeable limit. Chess clocks have also gained in popularity for use in other one-on-one barad games. Players of other games use time as an element to keep a game moving and to add and additional level of skill to a game.

In the past analog and digital chess clocks have been known as illustrated, for example, by U.S. Pat. Nos. 2,539,754 and 4,062,180. Such previously known chess clocks; however, have tended to be somewhat bulky and not easily stored or for transported to a lunch or pick-up game in a park or other casual play site. It would therefore be highly desirable to provide a chess clock that could provide a two player, self-actuated chess timing function while concomitantly being compact and easily portable to enable playing a competitive game of chess in a park during lunch—for example. Moreover, it would further be desirable to provide a chess game timing unit that could be facilely set with different time parameters to accommodate different skill levels of a two player board game such as chess. In this an experienced or skill player might be assigned a shorter time period than a less skillful opponent to facilely "level the playing field."

BRIEF SUMMARY OF THE INVENTION

The subject invention addresses the desires and concerns expressed above by providing a compact, collapsible, digital chess clock, or other game timing device, that is operable to be easily and compactly stored for transport and facilely set up to accurately time opposing player periods "on the clock" in a casual but competitive game environment.

The subject invention comprises a combination of four triangular interconnected panels that includes a digital electronic system for timing a chess game, or other timed game event, that can be unfolded into an opposing person environment to register accurate player timing visible by both players for both player times while permitting collapse and compact folding for transport and storage.

THE DRAWINGS

Other aspects of the present invention will become apparent from the following detailed description of preferred embodiments taken in conjunction with the accompanying drawings wherein.

DETAILED DESCRIPTION

Figure 1:
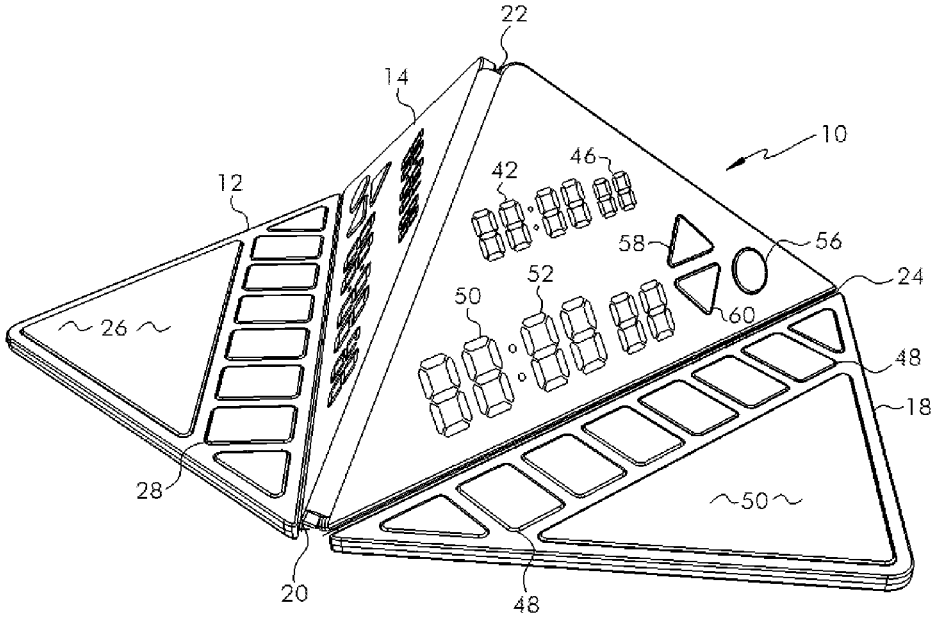
FIG. 1 is an axonometric view of a collapsible, chess clock in accordance with a preferred embodiment of the invention in a free standing operative configuration.
Figure 2:
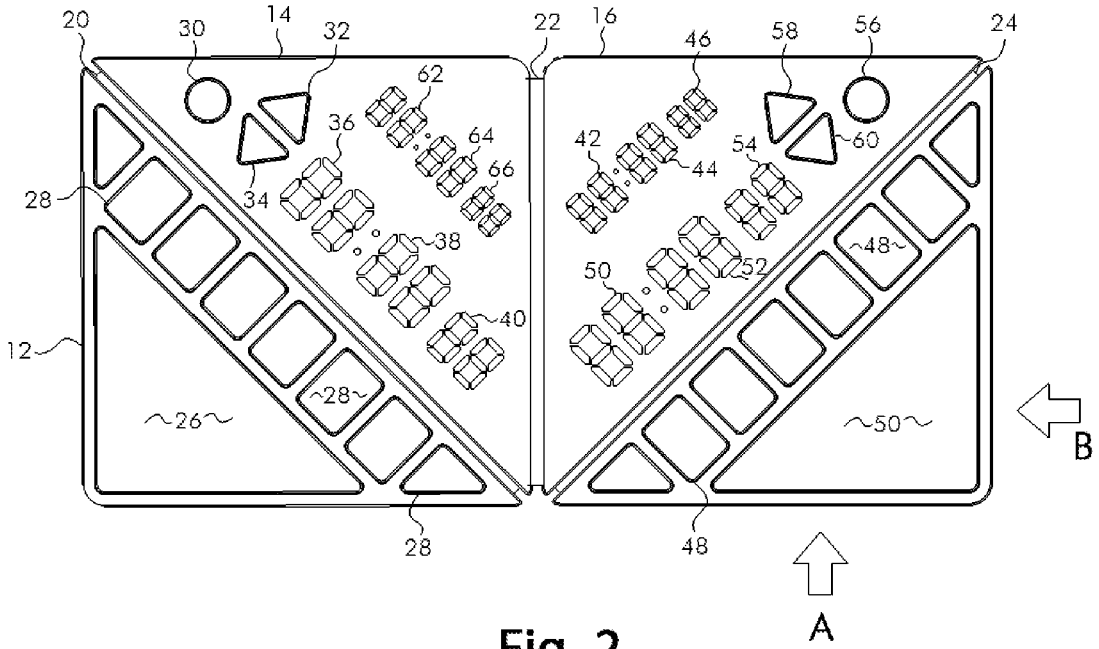
FIG. 2 is a plan view of the collapsible, chess clock as depicted in FIG. 1 unfolded into an essentially planer configuration.
Figure 3:
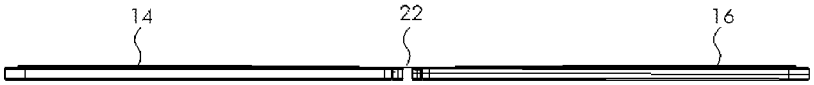
FIG. 3 is an edge view taken along directional arrow A in FIG. 2.
Figure 4:
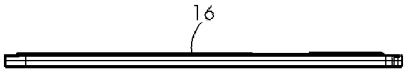
FIG. 4 is an edge view taken along directional arrow B in FIG. 2.

As disclosed in FIGS. 1 and 2 a compact and collapsible chess clock, or other game timing device 10, is composed of four generally planar, triangular, panels 12, 14, 16 and 18 that are connected in sequence by hinges 20, 22 and 24. The panels, per se, have a thickness (note FIGS. 3 and 4) and are preferably composed of a polymeric material with the hinges comprising living hinges to facilely permit folding of the panels for compact transport and storage (note FIG. 6 as an example).

The first panel 12 includes a player input pad 26 that is operable to receive a player input signal by manually depressing the pad. The panel 12 also includes an array of solar panels 28 that can operably be used to charge an internal panel battery while a game is in progress.

An adjoining triangular panel 14 is connected to panel 12 by a living hinge 20 and the panel 14 includes an LED light 30 to register a players "on the clock" turn during play. In addition panel 14 includes an up 32 and down 34 arrow button to increase or decrease a player or opponents time clock.

In a conventional game of chess each player (W and B) can be assigned an agreed set amount of time, which is typically two hours, to accomplish the players primary moves. The large LED hour register 36, minute 38 and second 40 time digits can be initially set by player W and once play begins can be electronically decremented down while player W is on the clock thinking and then making a move. At the same time that player W is on the clock and his time record is decrementing down on his panel 14 and a concomitant player W time use record is illustrated by smaller LED digits 42, 44 and 46 on player B's play panel 16.

All of the component on player W's panels 12 and 14 are duplicated on similar panels 16 and 18 for player B. In this player B has a set of solar panels 48 that are duplicates of player W panels 28. Player B has an input pad 50 identical to pad 26 and panel 16 includes a player B set of hour, minute and second digital time registers 50, 52, and 54 which record Player B's time "on the clock."

Player B also has an on the clock LED register 56 and up and down time adjustment arrows 58 and 60 to set the clock at the beginning of a game or to add secondary time.

Returning briefly to panel 14 the use time record 50, 52 and 54 of player B which is recorded on panel 16 and identifies for player B the time that is being used by player B while he is on the clock is also recorded simultaneously in smaller sized digital LED time registers 62, 64 and 66 on player W's visual panel 14.

Figure 5:
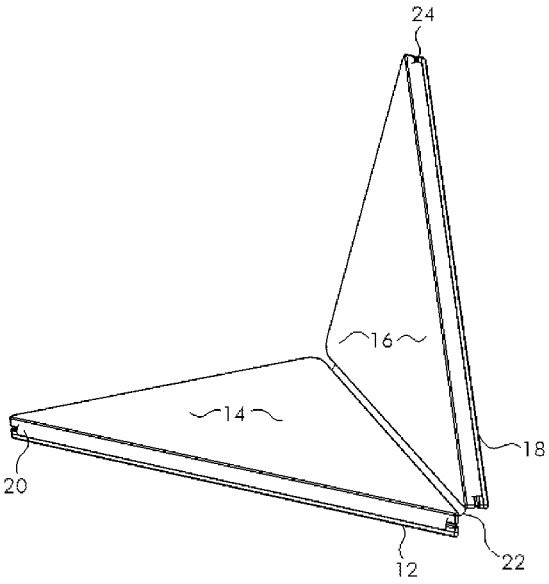
FIG. 5 is a schematic diagram of a partially folded chess clock as depicted in FIG. 1.
Figure 6:
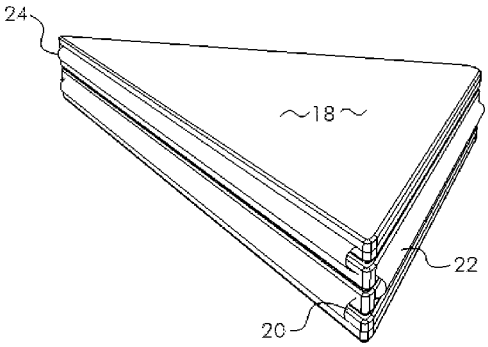
FIG. 6 is an illustration of a fully collapsed and folded chess clock as depicted in FIG. 1.

FIGS. 5-6 disclose views of the four panels 12, 16, 18 and 20 in stages of being folded into a compact triangular structure as depicted in FIG. 6. The panels a preferably composed of a flexible polymeric material or silicon rubber and the electronics can be operably embedded and enrobed within the flexible polymeric material.

In operation player W and B mutually decide the game that is to be played by designating the total time that is to be available to each player which is entered on both clocks using arrows 32, 34, 58 and 60. The time appears on the large led register for white and on the small register for B while B's time appears on the large register for B and smaller on the same register for W.

Once the game begins W's time register is started and his game clock decrements down until W makes a move and physically taps time panel 26 which will stop his clock register 36-40 and concomitantly start B's clock 50-54. At the same time the amount of time remaining for W is registered in small LED registers 42-46 that is visible to B at the top of his panel 16. This process goes back and forth as a game progresses until a checkmate is achieved, one player's time expires with a flashing zero time register for one player means the end of the game by time expiration forfeiture. Alternatively, by mutual consent, the players go into a second time phase segment by agreement where player time can be reentered and the game proceeds.

Although FIGS. 1-6 have illustrated a presently preferred embodiment of the subject compact, collapsible, chess clock the subject configuration, the geometric shape of the modules, etc. are meant to be illustrative and not exhaustive. There are an unlimited variety of timing schemes possible. For example, certain matches such as speed chess or fast chess that use small overall time limits (e.g. 25 minutes) add additional time for each move (e.g. 10 seconds). The chess clock can be programed to carry out this or any other timing scheme. The various aspects of the invention were chosen and described in order to best explain principles of the invention and its practical applications. The preceding description is intended to enable those of skill in the art to best utilize the invention in various embodiments and aspects and with modifications as are suited to the particular use contemplated. It is intended that the scope of the invention be defined by the following claims.

What is claimed is:

1. A collapsible chess clock comprising:

a first player time control panel having an outer perimeter configuration in the shape of a triangle;

a first player information panel having an outer perimeter configuration in the shape of a triangle and being pivotally connected along one side of the first player information panel to a side of the triangular first player time control panel;

a second player time control panel having an outer perimeter configuration in the shape of a triangle;

a second player information panel having an outer perimeter configuration in the shape of a triangle and being pivotally connected along one side of the second player information panel to a side of the triangular said second player and time control panel;

said first player information panel further being connected by another side of said first player triangular information panel to an another side of said second player triangular information panel wherein said first player time control panel may be operably folded over said first player information panel and said second player information panel may be operably folded over said second player information panel and said first player information panel may be folded over said second player information panel to form a compact stacked arrangement of said first player time control panel, said first player information panel, said second player information panel and said second player time control panel for facile transport and storage of said collapsible chess clock.

2. A collapsible chess clock as defined in claim 1 wherein:

a first player digital time and a second player digital time are both displayed on each of said first and second player information panels.

3. A collapsible chess clock as defined in claim 2 wherein:

a player's own digital time in each player's information panel is displayed in a larger font digital display as compared with the opponent's digital time display.

4. A collapsible chess clock as defined in claim 2 wherein:

each of said player's digital time is displayed in hours, minutes and seconds.

5. A collapsible chess clock as defined in claim 1 wherein:

upon expiration of a player's time the player's time register reflects a zero register on both of the first and second information panels and the zero time record reflecting a winning position by the player having remaining time.

6. A collapsible chess clock as defined in claim 5 wherein:

upon expiration of a player's time the player's time register reflects a flashing zero time register on both of the first and second information panels and the flashing zero time record reflecting a winning position by the player having time remaining.

7. A collapsible chess clock as defined in claim 1 wherein:

each of said player time control panels and player information panels are configured as isosceles triangles with all panels having equal side dimensions.

8. A collapsible game clock comprising:

a first player time control panel having an outer perimeter configured in a geometric shape with straight edges;

a first player information panel having an outer perimeter configuration similar to said first player time control panel and being pivotally connected along one side of the first player information panel to a side of the first player time control panel;

a second player time control panel having an outer perimeter configuration in the shape of said first player time control panel;

a second player information panel having an outer perimeter configuration similar to the outer perimeter configuration of said first player time control panel and being pivotally connected along one side of said second player information panel to a side of said first player information panel; and said first player information panel further being connected by another side of said first player information panel to an another side of said second player information panel wherein said first player time control panel may be operably folded over said first player information panel and said second player information panel may be operably folded over said second player information panel and said first player information panel may be folded over said second player information panel to form a compact stacked arrangement of said first player time control panel, said first player information panel, said second player information panel and said second player time control panel for facile transport and storage of said collapsible chess clock.

9. A collapsible chess clock as defined in claim 8 wherein:

a first player digital time and a second player digital time are both displayed on each of said first and second player information panels.

10. A collapsible chess clock as defined in claim 9 wherein:

a player's own digital time in each player's information panel is displayed in a larger font digital display as compared with the opponent's digital time display.

* * * * *